US007210396B2

(12) United States Patent
Kuehn et al.

(10) Patent No.: US 7,210,396 B2
(45) Date of Patent: May 1, 2007

(54) VALVE HAVING A HYSTERETIC FILTERED ACTUATION COMMAND

(75) Inventors: Jeffrey Lee Kuehn, Metamora, IL (US); Michael Todd VerKuilen, Metamora, IL (US)

(73) Assignees: Caterpillar Inc, Peoria, IL (US); Shin Caterpillar Mitsubishi Ltd. (JP)

( * ) Notice: Subject to any disclaimer, the term of this patent is extended or adjusted under 35 U.S.C. 154(b) by 0 days.

(21) Appl. No.: 11/214,979

(22) Filed: Aug. 31, 2005

(65) Prior Publication Data

US 2007/0044650 A1 Mar. 1, 2007

(51) Int. Cl.
*F15B 13/04* (2006.01)

(52) U.S. Cl. ..... 91/454; 91/433; 60/461

(58) Field of Classification Search ..... 91/420, 91/433, 454; 60/460, 461, 466
See application file for complete search history.

(56) References Cited

U.S. PATENT DOCUMENTS

| | | | |
|---|---|---|---|
| 3,366,202 | A | 1/1968 | James |
| 3,809,036 | A | 5/1974 | Knapp et al. |
| 4,046,270 | A | 9/1977 | Baron et al. |
| 4,222,409 | A | 9/1980 | Budzich |
| 4,250,794 | A | 2/1981 | Haak et al. |
| 4,416,187 | A | 11/1983 | Nystrom |
| 4,437,385 | A | 3/1984 | Kramer et al. |
| 4,454,713 | A | 6/1984 | Meyer et al. |
| 4,480,527 | A | 11/1984 | Lonnemo |
| 4,581,893 | A | 4/1986 | Lindbom |
| 4,586,330 | A | 5/1986 | Watanabe et al. |
| 4,623,118 | A | 11/1986 | Kumar |
| 4,662,601 | A | 5/1987 | Andersson |
| 4,706,932 | A | 11/1987 | Yoshida et al. |
| 4,747,335 | A | 5/1988 | Budzich |
| 4,799,420 | A | 1/1989 | Budzich |
| 4,822,113 | A | 4/1989 | Amberg et al. |
| 5,137,254 | A | 8/1992 | Aardema et al. |
| 5,152,142 | A | 10/1992 | Budzich |
| 5,211,196 | A | 5/1993 | Schwelm |
| 5,287,794 | A | 2/1994 | Andersson |
| 5,297,381 | A | 3/1994 | Eich et al. |
| 5,313,873 | A | 5/1994 | Gall et al. |
| 5,350,152 | A | 9/1994 | Hutchison et al. |
| 5,366,202 | A | 11/1994 | Lunzman |
| 5,447,093 | A | 9/1995 | Budzich |
| 5,477,677 | A | 12/1995 | Krnavek |
| 5,537,818 | A | 7/1996 | Hosseini et al. |
| 5,553,452 | A | 9/1996 | Snow et al. |
| 5,568,759 | A | 10/1996 | Aardema |

(Continued)

FOREIGN PATENT DOCUMENTS

| | | |
|---|---|---|
| EP | 1403526 | 3/2004 |

(Continued)

*Primary Examiner*—Michael Leslie
(74) *Attorney, Agent, or Firm*—Finnegan, Henderson, Farabow, Garrett & Dunner

(57) ABSTRACT

The present disclosure is directed to a valve system including a controller and a valve including a valve element and a valve bore. The valve element is selectively movable relative to the valve bore at least partially in response to a signal communicated from a controller. The communicated signal is at least partially based on a load on the actuator and a determined pressured drop. The determined pressure drop is at least partially based on a hysteretic filter.

21 Claims, 3 Drawing Sheets

U.S. PATENT DOCUMENTS 5,678,470 A 10/1997 Koehler et al.
5,701,933 A 12/1997 Lunzman
5,813,226 A 9/1998 Krone
5,813,309 A 9/1998 Taka et al.
5,857,330 A 1/1999 Ishizaki et al.
5,868,059 A 2/1999 Smith
5,878,647 A 3/1999 Wilke et al.
5,890,362 A 4/1999 Wilke
5,947,140 A 9/1999 Aardema et al.
5,960,695 A 10/1999 Aardema et al.
6,009,708 A 1/2000 Miki et al.
6,026,730 A 2/2000 Yoshida et al.
6,082,106 A 7/2000 Hamamoto
6,216,456 B1 4/2001 Mitchell
6,361,122 B2 3/2002 Anderson et al.
6,367,365 B1 4/2002 Weichert et al.
6,371,573 B1 4/2002 Goebels et al.
6,467,264 B1 10/2002 Stephenson et al.
6,502,393 B1 1/2003 Stephenson et al.
6,502,500 B2 1/2003 Yoshino
6,516,614 B1 2/2003 Knoll
6,598,391 B2 7/2003 Lunzman et al.
6,619,183 B2 9/2003 Yoshino
6,655,136 B2 12/2003 Holt et al.
6,662,705 B2 12/2003 Huang et al.
6,665,136 B2 12/2003 Holt et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
2002/0162327 A1 11/2002 Stephenson et al.
2003/0041728 A1 3/2003 Lunzman et al.
2003/0121256 A1 7/2003 Mather
2003/0121408 A1 7/2003 Linerode et al.
2003/0121409 A1 7/2003 Lunzman et al.
2003/0125840 A1 7/2003 Lunzman et al.
2003/0196545 A1 10/2003 Jensen et al.
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.

FOREIGN PATENT DOCUMENTS

JP 02613041 B2 5/1997

VALVE HAVING A HYSTERETIC FILTERED ACTUATION COMMAND

TECHNICAL FIELD

The present disclosure is directed to a valve and, more particularly, to a valve having a hysteretic filtered actuation command.

BACKGROUND

Hydraulic systems are often used to control the operation of hydraulic actuators of work machines. These hydraulic circuits typically include valves that are fluidly connected between the actuator and a pump and valves that are fluidly connected between the actuator and a reservoir. The valves control a flow rate and direction of pressurized fluid to and from chambers of the actuator to create pressure differentials within the actuator to affect movement thereof. Often, one or more of these valves are controlled in response to the pressure of the pressurized fluid within a portion of the hydraulic system and/or an associated chamber of the hydraulic actuator to reduce lag time between changing operational demands and valve actuation. Pressures within the hydraulic systems and, in particular, within chambers of the hydraulic actuators, however, may oscillate rapidly causing the valves to have overactive displacements which may lead to valve instability and/or premature wear.

A method of operating a hydraulic actuator is described in U.S. Pat. No. 6,467,264 B1 ("the '264 patent") issued to Stephenson et al. The '264 patent discloses a pair of supply valves to direct fluid from a pump to respective head-end and rod-end chambers of a piston-cylinder arrangement. The '264 patent also discloses a pair of drain valves to direct fluid from respective head-end and rod-end chambers of the piston-cylinder arrangement to a reservoir. Each of the head-end and rod-end valves are proportional valves actuated by solenoids to selectively allow fluid to and/or from the piston-cylinder arrangement. The '264 patent further discloses a metering valve to control the pressure drop across the drain valves to improve the accuracy of the flow of fluid to the reservoir.

Although the metering valve of the '264 patent may control the pressure drop across a drain valve directing fluid from the piston-cylinder arrangement to the reservoir, it may not increase stability of the drain valve by reducing overactive displacements.

The present disclosure is directed to overcoming one or more of the problems set forth above.

SUMMARY OF THE INVENTION

In a first aspect, the present disclosure is directed to a valve system including a controller and a valve including a valve element and a valve bore. The valve element is selectively movable relative to the valve bore at least partially in response to a signal communicated from a controller. The communicated signal is at least partially based on a load on the actuator and a determined pressured drop. The determined pressure drop is at least partially based on a hysteretic filter.

In another aspect, the present disclosure is directed to a method of actuating a valve having a valve element movable relative to a valve bore. The method includes determining a desired flow of pressurized fluid through the valve at least partially based on an operator input. The method also includes determining a load on an actuator fluidly connected upstream of the valve. The method further includes determining a desired pressure drop at least partially based on the determined load pressure and a hysteretic filter. The method still further includes determining a desired flow area of the valve at least partially based on the determined flow of pressurized flow and the determined pressure drop. The method still further includes moving the valve element to establish the determined flow area.

DETAILED DESCRIPTION

Figure 1:
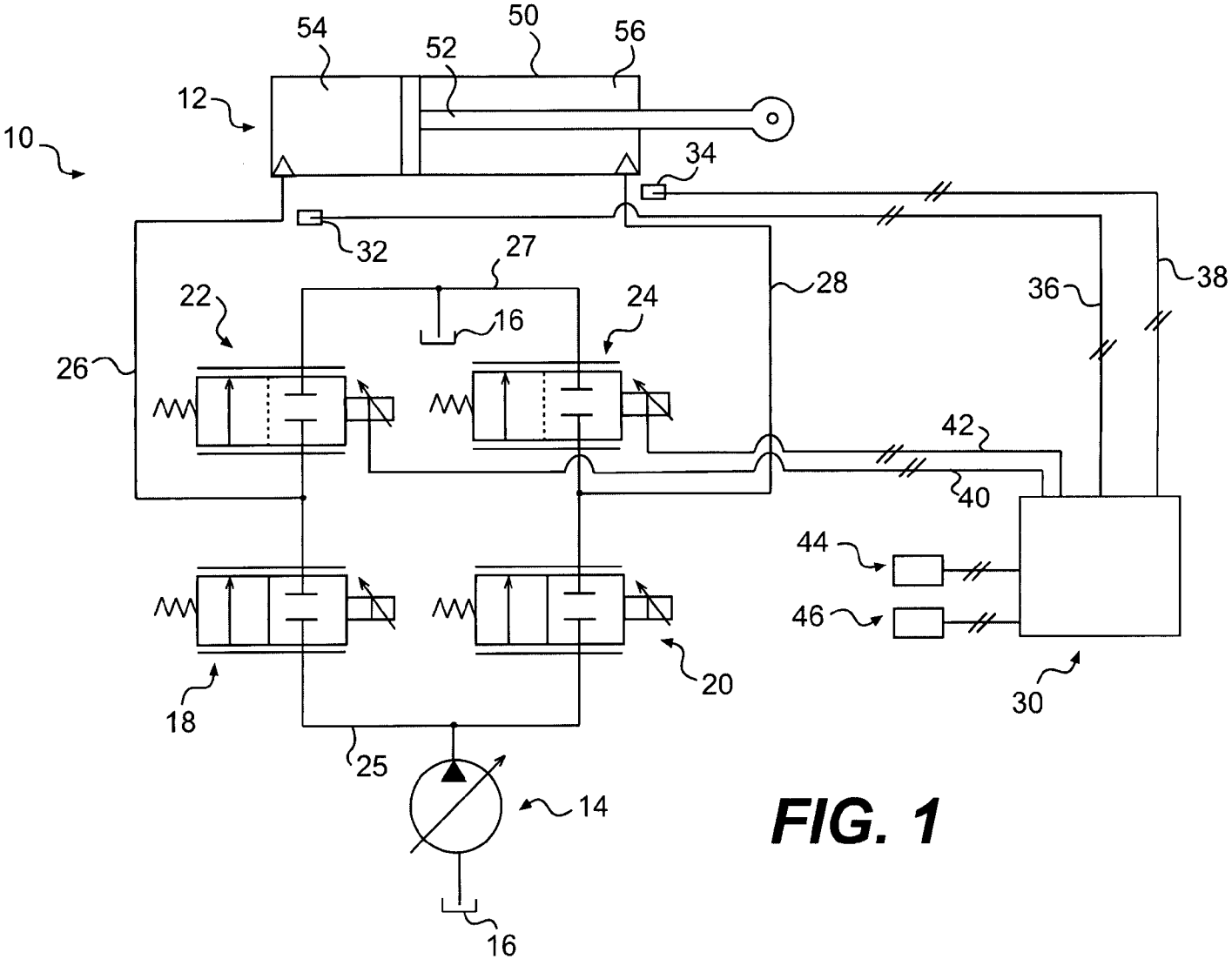
FIG. 1 is a schematic illustration of an exemplary disclosed hydraulic system.

FIG. 1 illustrates a hydraulic system 10 that may include various components that cooperate to actuate hydraulic cylinder 12. Hydraulic cylinder 12 may be connected to various work machine components, such as, for example, linkages (not shown), work implements (not shown), and/or frames (not shown). Hydraulic system 10 may include a source 14 of pressurized fluid, a tank 16, a head-end supply valve 18, a head-end drain valve 22, a rod-end supply valve 20, and a rod-end drain valve 24. It is contemplated that hydraulic system 10 may include additional and/or different components such as, for example, a pressure sensor, a temperature sensor, a position sensor, a controller, an accumulator, and/or other components known in the art.

Hydraulic actuator 12 may include a piston-cylinder arrangement, a hydraulic motor, and/or any other known hydraulic actuator having one or more fluid chambers therein. For example, hydraulic actuator 12 may include a tube 50 and a piston assembly 52 disposed within tube 50. One of tube 50 and piston assembly 52 may be pivotally connected to a frame, while the other of tube 50 and piston assembly 52 may be pivotally connected to a work implement. Hydraulic actuator 12 may include a first chamber 54 and a second chamber 56 separated by piston assembly 52. The first and second chambers 54, 56 may be selectively supplied with pressurized fluid to cause piston assembly 52 to displace within tube 50, thereby changing the effective length of hydraulic actuator 12. The expansion and retraction of hydraulic actuator 12 may function to assist in moving one or both of the frame and the work implement. It is contemplated that hydraulic actuator 12 may be connected to and/or between any components of a work machine to affect relative movement therebetween.

Displacement of piston assembly 52 may be caused by an imbalance of force acting on opposite sides of piston assembly 52 as is conventional in the art. An imbalance of force may be caused by fluid pressure within one of first and second chambers 54, 56 being different than fluid pressure within the other one of first and second chambers 54, 56. It is noted that a relatively large pressure differential may establish an overrunning operation of hydraulic actuator 12 and relatively small pressure differential may establish a restrictive operation of hydraulic actuator 12. For example, an overrunning operation may be desired for quick movement of piston assembly 52, e.g., when a load acts against the movement of hydraulic actuator 12. For another example, a restrictive operation may be desired for a slow movement of hydraulic actuator 12, e.g., when a load acts with the movement of hydraulic actuator 12.

Source 14 may be configured to produce a flow of pressurized fluid and may include a pump such as, for example, a variable displacement pump, a fixed displacement pump, or any other source of pressurized fluid known in the art. Source 14 may be drivably connected to a power source (not shown) of a work machine by, for example, a countershaft, a belt, an electrical circuit, and/or in any other suitable manner. Source 14 may be dedicated to supplying pressurized fluid only to hydraulic system 10, or alternately may supply pressurized fluid to additional hydraulic systems (not shown) within a work machine.

Tank 16 may include a source of low pressure, such as, for example, a reservoir configured to hold a supply of fluid. The fluid may include, for example, a dedicated hydraulic oil, an engine lubrication oil, a transmission lubrication oil, or any other working fluid known in the art. One or more hydraulic systems may draw fluid from and return fluid to tank 16. It is also contemplated that hydraulic system 10 may be connected to multiple, separate fluid tanks. It is contemplated that tank 16 may include any low pressure fluid source known in the art, such as, for example, a sump.

Head-end and rod-end supply valves 18, 20 may be disposed between source 14 and hydraulic actuator 12 and may be configured to regulate a flow of pressurized fluid to first and second chambers 54, 56. Specifically, head-end and rod-end supply valves 18, 20 may each include a two-position spring biased valve mechanism that may be solenoid actuated and configured to move between a first position at which fluid is allowed to flow into first and second chambers 54, 56 and a second position at which fluid flow is blocked from flowing to first and second chambers 54, 56. It is contemplated that head-end and rod-end supply valves 18, 20 may include additional and/or different valve mechanisms such as, for example, a proportional valve element and/or any other valve mechanisms known in the art.

Head-end and rod-end drain valves 22, 24 may be disposed between hydraulic actuator 12 and tank 16 and may be configured to regulate a flow of pressurized fluid from first and second chambers 54, 56 to tank 16. Specifically, head-end and rod-end drain valves 22, 24 may each include a proportional spring biased valve mechanism that may be solenoid actuated and configured to move between a plurality of flow passing positions at which fluid is allowed to flow from first and second chambers 54, 56 and a flow blocking position at which fluid is blocked from flowing from first and second chambers 54, 56. It is contemplated that head-end and rod-end drain valves 22, 24 may include additional and/or different valve mechanisms such as, for example, a two-position valve element and/or any other valve mechanism known in the art.

Head-end and rod-end supply and drain valves 18, 20, 22, 24 may be fluidly interconnected. In particular, head-end and rod-end supply valves 18, 20 may be connected in parallel to a common supply passageway 25 that may be configured to fluidly communicate pressurized fluid from source 14 to head-end and rod-end supply valves 18, 20. Head-end and rod-end drain valves 22, 24 may be connected in parallel to a common drain passageway 27 that may be configured to fluidly communicate pressurized fluid from head-end and rod-end drain valves 22, 24 to tank 16. Head-end supply and drain valves 18, 22 may be connected in parallel to a first chamber passageway 26 that may be configured to fluidly communicate pressurized fluid to and from first chamber 54. Rod-end supply and drain valves 20, 24 may be connected in parallel to a second chamber passageway 28 that may be configured to fluidly communicate pressurized fluid to and from second chamber 56.

A controller 30 may control the actuation of head-end and rod-end drain valves 22, 24. Controller 30 may include one or more microprocessors, a memory, a data storage device, a communications hub, and/or other components known in the art. It is contemplated that controller 30 may be integrated within a general work machine control system capable of controlling additional various functions of a work machine. Controller 30 may be configured to receive input signals from first and second pressure sensors 32, 34 via first and second communication lines 36, 38. Controller 30 may perform one or more algorithms to determine appropriate output signals to control head-end and rod-end drain valves 22, 24 and may deliver the output signals via third and fourth communication lines 40, 42. It is contemplated that controller 30 may be further configured to receive additional inputs 44 indicative of various operating parameters of hydraulic system 10 and/or additional components of an associated work machine 10, such as, for example, temperature sensors, position sensors, and/or any other parameter known in the art. It is also contemplated that controller 30 may be configured to control the operation of head-end and rod-end supply valves 18, 20 and/or additional components 46 of hydraulic system 10 and/or an associated work machine, such as, for example, visual displays and/or any other component known in the art.

First and second pressure sensors 32, 34 may include any known pressure sensor and may be configured to sense the pressure indicative of the pressurized fluid within first and second chambers 54, 56. First and second pressure sensors 32, 34 may be disposed at any location relative to hydraulic system 10, such as, for example, relative to first and second chamber supply passageways 26, 28, relative to first and second chambers 54, 56, and/or any other suitable location.

Figure 2:
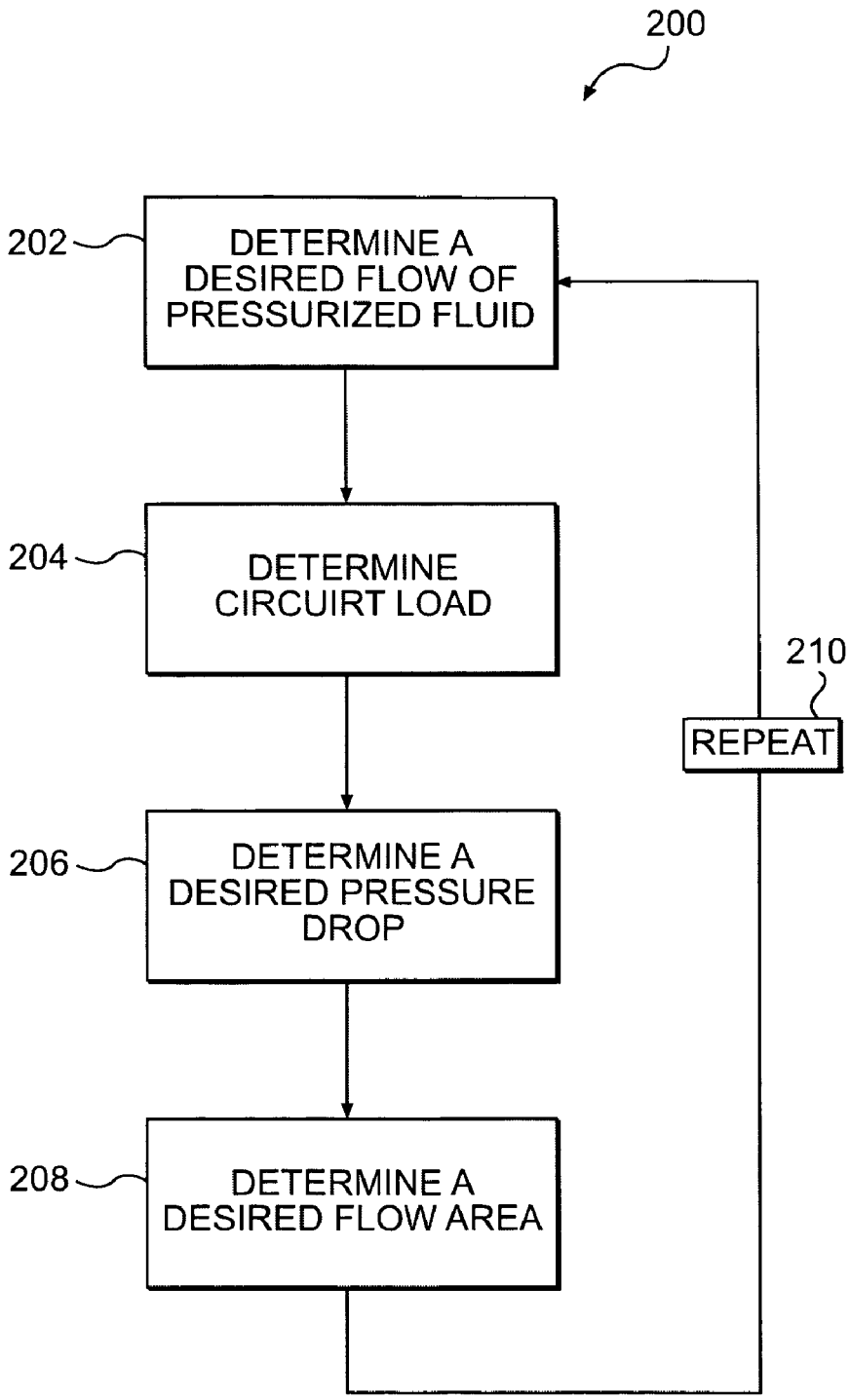
FIG. 2 is a flow chart of an exemplary method to control the head-end and rod-end drain valves of FIG. 1.

FIG. 2 illustrates an exemplary method 200 which controller 30 may perform to determine a desired flow area of head-end and rod-end drain valves 22, 24 to establish a desired actuation thereof. Method 200 will be described with reference to the actuation of head-end drain valve 22 for clarification purposes. It is understood that method 200 may be applicable to the actuation of rod-end drain valve 24. Method 200 may include determining a desired flow of pressurized fluid (step 202), determining a circuit load (step 204), determining a desired pressure drop (step 206), determining a desired flow area (step 208), and may repeat (step 210) continuously, as desired.

Step 202 may include determining a flow of pressurized fluid desired to flow through head-end drain valve 22 and may be based at least in part on an operator input. Specifically, controller 30 may be configured to determine a desired flow of pressurized fluid through head-end drain valve 22 for a particular operation of hydraulic actuator 12 by, for example, look-up tables, equations, and/or maps. It is contemplated that the desired flow of pressurized fluid may also be based on, for example, the control of rod-end supply valve 20, the valve dynamics of rod-end supply valve 20, and/or be determined by other known methods.

Step 204 may include determining a circuit load which approximates the load on hydraulic actuator 12. Specifically, controller 30 may approximate the load on hydraulic actuator 12 based on the forces acting on hydraulic actuator 12 by sensing pressures of the pressurized fluid within first and second chambers 54, 56. For example, the circuit load may be determined by relating the sensed pressures to circuit loads via, for example, look-up tables, equations, and/or maps. It is contemplated that controller 30 may determine the circuit load by determining the imbalance of force across piston assembly 52 by proportionally relating the pressure of pressurized fluid within first chamber 54 and the area of the first chamber side of piston assembly 52 to the pressure of pressurized fluid within second chamber 56 and the area of second chamber side of piston assembly 52. It is also contemplated that controller 30 may determine the circuit load as an approximation based on only the pressure of fluid in the one of first and second chambers 54, 56 fluidly connected to tank 16. It is further contemplated that the circuit load may be determined by any other suitable method known in the art, such as, for example, through the use of a load cell suitably connected to actuator 12 as is known in the art. It is noted that circuit load, as used herein, approximates a load on an actuator as affected by internal system forces, e.g., hydraulic pressures acting on a piston within a cylinder, and/or external forces, e.g., loads acting to extend and/or retract the actuator, friction forces, and/or inertial forces. It is further noted that because hydraulic system 10 may have a plurality of actuators, hydraulic system 10 may have a plurality of circuit loads each representing the load on an associated actuator.

Step 206 may include determining a pressure drop across head-end drain valve 22 based in part on a functional relationship with the determined circuit load. Specifically, controller 30 may be configured to determine a desired pressure drop across head-end drain valve 22 via a hysteretic filter logic 300 and on the determined circuit load. Hysteric filter logic 300 will be described in more detail below with reference to FIG. 3.

Step 208 may include determining a flow area of head-end drain valve 22 based on a functional relationship with the desired flow and the desired pressure drop. Specifically, controller 30 may be configured to determine a desired flow area of the valve element of head-end drain valve 22 necessary to direct the desired flow of pressurized fluid through head-end valve 22 and provide the desired pressure drop across head-end drain valve 22. The desired flow area may be determined by, for example, look-up tables, equations, and/or maps. It is noted that for a given desired flow of pressurized fluid, a substantially constant pressure drop may result in a substantially constant flow area, e.g., fluid flow may be a function of the pressure drop across a constant flow area, as is known in the art. It is contemplated that a change in desired flow of pressurized fluid may result in a corresponding change in flow area regardless of a change in pressure drop. It is also contemplated that controller 30 may control the displacement of the valve element of head-end drain valve 22 to establish the desired flow area therethrough.

Figure 3:
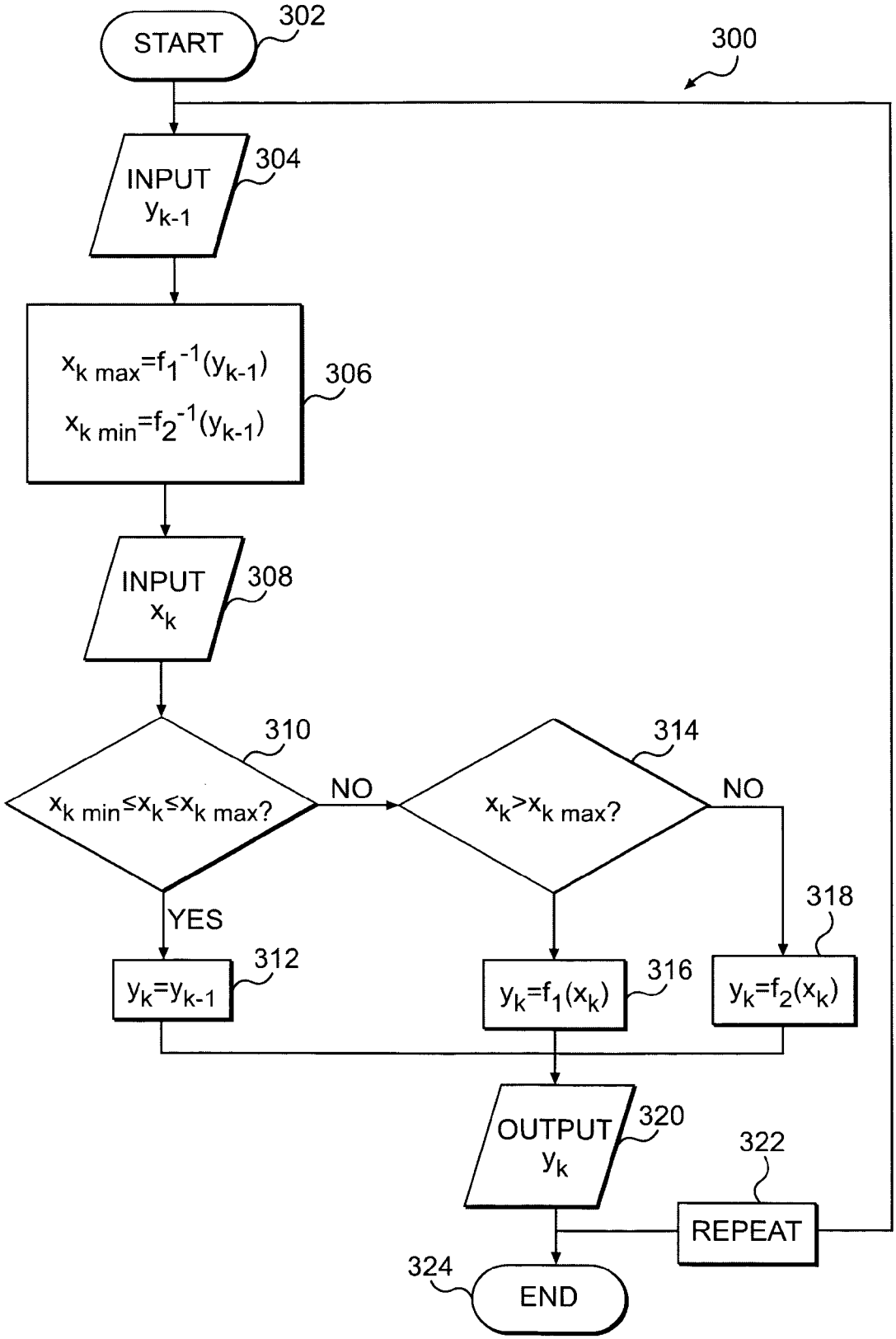
FIG. 3 is a schematic illustration of an exemplary hysteretic filter logic for determining the pressure drop across the head-end and rod-end drain valves of FIG. 1.

FIG. 3 illustrates an exemplary hysteretic filter logic 300 which controller 30 may perform to determine the desired pressure drop for head-end drain valve 22 (step 206). Hysteretic filter logic 300 may be configured to determine a desired pressure drop that may be different than a previous pressure drop only when a determined circuit load exceeds maximum or minimum thresholds. Hysteretic filter logic 300 may further be configured to relate increasing circuit loads with desired pressure drops based on a first functional relationship $y_k=f_1(x_k)$, wherein $y_k$ represents the desired pressure drop and $x_k$ represents the determined circuit load. Hysteretic filter logic 300 may further be configured to relate decreasing circuit loads with desired pressure drops based on a second functional relationship $y_k=f_2(x_k)$. It is contemplated that the functional relationships for increasing and decreasing circuit loads may represent any mathematical relationship such as, for example, linear, parabolic, and/or other powered relationships relating determined circuit load and desired pressure drop. It is also contemplated that the functional relationship for decreasing circuit loads would establish a greater desired pressure drop than the functional relationship for increasing circuit loads. As such, hysteretic filter logic 300 may include a bias toward establishing restrictive operation of hydraulic actuator 12 rather than an overrunning operation of hydraulic actuator 12.

Hysteretic filter logic 300 may start (step 302) when a desired actuation of hydraulic actuator 12 is performed and, more particularly, may start (step 302) when an actuation of head-end drain valve 22 is desired. Hysteretic filter logic 300 may receive an input $y_{k-1}$ indicative of the last determined desired pressure drop (step 304) and may calculate the maximum $x_{k\ max}$ and minimum $x_{k\ min}$ load pressure threshold values (step 306) based on the last determined pressure drop. Hysteretic filter logic 300 may also receive an input $x_k$ indicative of the present circuit load (step 308). Hysteretic filter logic 300 may compare the present circuit load $x_k$ with the maximum $x_{k\ max}$ and minimum $x_{k\ min}$ load pressure threshold values (steps 310, 314) to select and perform an appropriate functional relationship $y_k=y_{k-1}$, $y_k=f_1(x_k)$, $y_k=f_2(x_k)$ to determine the desired pressure drop $y_k$ based on the present circuit load $x_k$ (steps 312, 316, 318). Hysteretic filter logic 300 may output the determined desired pressure drop $y_k$ (step 320) and may repeat (step 322) to continuously determine desired pressure drops as controller 30 actuates head-end drain valve 22, as desired. Hysteretic filter logic 300 may end (step 324) when actuation of head-end drain valve 22 is no longer desired.

Step 304 may include establishing the last determined desired pressure drop. It is contemplated that for the first sequence performed by hysteretic filter logic 300, the last determined pressure drop may be initially set to any constant, such as, for example, zero.

Step 306 may include determining the maximum $x_{k\ max}$ and minimum $x_{k\ min}$ load pressure threshold values based on the algebraic inverse of the functional relationships for increasing and decreasing circuit loads. Specifically, the maximum threshold value may be determined by algebraically inverting the functional relationship for increasing circuit loads. For example, if the functional relationship for increasing circuit loads is a linear relationship, such as, for example, $y=f_1(x)=x+C$, where y represents a desired pressure drop, $f_1(x)$ represents the increasing functional relationship, x represents the circuit load, and C represents a constant, the maximum threshold value may be determined as $x=f_1^{-1}(y)=y-C$. The minimum threshold value may be similarly determined.

Step 310 may include determining whether or not the determined circuit load is greater than or equal to the minimum threshold value and less than or equal to the maximum threshold value. If so, hysteretic filter logic 300 may progress to step 312 which may include determining the desired pressure drop to be substantially equal to the previous determined pressure drop. As such, hysteretic filter logic 300 may not establish a new pressure drop because the determined circuit load may not be sufficiently different than the previous circuit load. If not so, hysteretic filter logic 300 may progress to step 314.

Step 314 may include determining whether or not the determined circuit load is greater than the maximum threshold value. If so, hysteretic filter logic 300 may progress to step 316 which may include determining the desired pressure drop based on the increasing functional relationship. As such, hysteretic filter logic 300 may establish a new pressure drop because the determined circuit load may have sufficiently increased over that of the previous circuit load, e.g., the circuit load may have sufficiently changed to indicate increasing loads are acting on hydraulic actuator 12. If not so, hysteretic filter logic 300 may progress to step 318.

Step 318 may include determining the desired pressure drop based on the decreasing functional relationship. If hysteretic filter logic 300 progresses to step 318, the determined circuit load may be recognized to be less than the minimum threshold value because the determined circuit load is not greater than or equal to the minimum threshold value (step 310) and the determined circuit load is not greater than the maximum threshold value (step 314). As such, hysteretic filter logic 300 may establish a new pressure drop because the determined circuit load may have sufficiently decreased over that of the previous circuit load, e.g., the circuit load may have sufficiently changed to indicate decreasing loads are acting on hydraulic actuator 12.

Step 320 may include outputting the appropriately determined desired pressure drop which may then be functionally related with the desired flow of pressurized fluid to determine the desired flow area of head-end drain valve 22 in step 208 of method 200 (FIG. 2). As noted above, for a given flow area of head-end drain valve 22, the amount of desired flow therethrough may be a function of the pressure drop across head-end drain valve 22.

INDUSTRIAL APPLICABILITY

The disclosed valve may be applicable to any hydraulic system that includes a fluid actuator where fluid is directed from the actuator to a tank. The disclosed valve may reduce overactive valve actuation due to pressure oscillations, reduce energy necessary to operate the hydraulic actuator by establishing overrunning operations when appropriate, improve valve response to changing system pressures, and/or improve operation of the hydraulic system. The operation of hydraulic system 10 and, in particular, head-end drain valve 22 will be explained below.

Referring to FIG. 1, hydraulic cylinder 12 may be movable by fluid pressure in response to an operator input. Fluid may be pressurized by source 14 and directed to head-end and rod-end supply valves 18 and 20. In response to an operator input to either extend or retract piston assembly 52 relative to tube 50, one of the valve elements of one of head-end and rod-end supply valves 18, 20 may move to the open position to direct the pressurized fluid to the appropriate one of first and second chambers 54, 56. Controller 30 may, in response to operator input, determine a desired flow area for the appropriate one of head-end and rod-end drain valves 22, 24 desired to be moved into a flow passing position to direct pressurized fluid to tank 16.

Referring to FIG. 2, controller 30 may determine a desired flow of pressurized fluid through the flow passing drain valve, e.g., the one of head-end and rod-end drain valves 22, 24 desired to be moved into a flow passing position based in part on the operator input. Specifically, controller 30 may, for a given operator input, determine (step 202) a corresponding flow of pressurized fluid that may be desired through one of head-end and rod-end drain valves 22, 24 to establish an appropriate pressure differential across piston assembly 52 (FIG. 1) to cause a desired movement of hydraulic actuator 12.

For example, for an extension of hydraulic actuator 12 and a given flow of pressurized fluid through head-end supply valve 18, a relatively large flow of pressurized fluid through rod-end drain valve 22 (overrunning operation) may provide a greater pressure differential across piston assembly 52 than a relatively small flow of pressurized fluid through rod-end drain valve 22 (restrictive operation). A similar relationship may be appropriate for a retraction of hydraulic actuator 12. It is contemplated that overrunning and resistive movement of hydraulic actuator 12 may be adjusted and/or controlled for any number of various operator inputs to extend and/or retract hydraulic actuator 12, as desired.

The following explanation of a restrictive retraction of hydraulic actuator 12 is provided for clarification purposes only. It is noted that the operation of hydraulic system 10 and, in particular, the operation of hysteretic filter logic 300 explained below is applicable to control hydraulic actuator 12 in any number of various operations.

Referring to FIG. 1, to retract hydraulic actuator 12, rod-end supply valve 20 may move to a flow passing position to direct a flow of pressurized fluid to second chamber 56 in response to an operator input. Controller 30 may receive pressure signals from first and second pressure sensors 32, 34.

Referring to FIG. 2, controller 30 may determine a desired flow of pressurized fluid through head-end drain valve 22 required to affect the appropriate retraction of hydraulic actuator 12 for the desired operator input (step 202). Controller 30 may also resolve the received pressure signals which may indicate a low circuit load (step 204). For example, a low circuit load may be the result of an associated load aiding in the retraction of hydraulic actuator 12, e.g., the associated load may be pushing on piston assembly 52. As such, it may be desired to retract hydraulic actuator 12 slowly so as to increase the stability of hydraulic actuator 12 and correspondingly increase the stability of moving the associated load.

Referring to FIG. 3, controller 30 may perform hysteretic filter logic 300 to determine the desired pressure drop across head-end drain valve 22. For example, the functional relationship for increasing circuit loads $f_1(x_k)$ may be a linear relationship, such as, $f_1(x_k)=x$, and the functional relationship for decreasing load pressures $f_2(x_k)$ may be a linear relationship, such as, $f_2(x_k)=x+1$. Also for example, the input (step 304) of the previous determined pressure drop $y_{k-1}$ may be set to zero for the first sequence of hysteretic filter logic 300. As such, the maximum threshold value may be:

$$x_{k\,max}=f_1^{-1}(y_{k-1})=y=0$$

and the minimum threshold value may be:

$$x_{k\,min}=f_2^{-1}(y_{k-1})=y-1=-1.$$

Accordingly, if the determined circuit load $x_k$ functionally relates to be less than or equal to 0 and greater than or equal to −1, the desired pressure drop may remain at the previous determined pressure drop, $y_k=y_{k-1}=0$. However, because the determined circuit load may be greater than the maximum threshold value, a desired pressure drop may be established based on the determined circuit load $x_k$ and the functional relationship for increasing circuit loads $f_1(x_k)$. Hysteretic filter logic 300 may be repeated as desired to determine desired pressure drops in response to changing circuit loads. It is noted that for clarification purposes only the functional relationships are represented with simple numerals and that actual relationships account for orders of magnitude, units, and/or other factors necessary and/or desired to relate circuit loads and desired pressure drops.

Referring again to FIG. 2, controller 30 may determine the desired flow area of head-end drain valve 22 (step 208)

based on the desired flow of pressurized fluid and the determined pressure drop. Controller 30 may communicate a control signal via communication line 40 to displace the valve element of head-end drain valve 22 to establish the desired flow area (see FIG. 1). For example, if hysteretic filter logic 300 establishes the desired pressure drop to be substantially equal to the previous pressure drop, $y_k=y_{k-1}$, e.g., the determined circuit load did not exceed the threshold values, the determined flow area will be substantially equal to the previous determined flow area and controller 30 may not displace the valve element of head-end drain valve 22. Similarly, if hysteretic filter logic 300 establishes the desired pressure drop based on the functional relationship for increasing circuit loads $y_k=f_1(x_k)$, e.g., the determined circuit load exceeded the maximum threshold value, the determined flow area may be different than the previous determined flow area and controller 30 may displace the valve element of head-end drain valve 22. A similar relationship is applicable if hysteretic filter logic 300 establishes the desired pressure drop based on the functional relationship for decreasing circuit loads $y_k=f_2(x_k)$, e.g., the determined circuit load exceeded the minimum threshold value.

Method 200 and, in particular, hysteretic filter logic 300, may be substantially continuously repeated for a given operator command to retract hydraulic actuator 12. Accordingly, subsequent pressure signals may be received by controller 30 from first and second pressure sensors 32, 34, subsequent circuit loads may be determined and compared to subsequent threshold values, subsequent pressure drops may be determined, and subsequent control signals may be communicated to head-end drain valve 22. As such, the displacement of the valve element of head-end drain valve 22 may only be actuated in response to pressure changes that establish a circuit load that exceeds the threshold values. Hysteretic filter logic 300 may establish a circuit load deadband which must be overcome before valve element displacement may occur. Such a deadband may effectively prohibit small pressure oscillations from affecting valve displacement while allowing large pressure fluctuations to affect valve displacement without undesirable delay.

Because hysteretic filter logic 300 establishes threshold values, minor oscillations in pressure acting on hydraulic actuator 12 may not result in corresponding movement of the valve element of head-end drain valve 22. As such, the stability of head-end drain valve 22 may be increased by reducing overactive displacements. Also, because overrunning operations may be established, unnecessarily restrictive pressure drops across drain valves may be reduced to increase the efficiency of hydraulic system 10. Additionally, because the threshold values are determined in each sequence of hysteretic logic 300, the threshold range of circuit loads that may not establish new pressure drops, adjusts as the circuit load increases and decreases. As such, the threshold range may track with the circuit load and may provide increased flexibility in control of head-end drain valve 22. Furthermore, because head-end drain valve is based in part on circuit loads, lag time between changes in circuit loads and valve element actuation may be reduced.

It will be apparent to those skilled in the art that various modifications and variations can be made to the disclosed valve having a hysteretic filtered actuation command. Other embodiments will be apparent to those skilled in the art from consideration of the specification and practice of the disclosed valve. It is intended that the specification and examples be considered as exemplary only, with a true scope being indicated by the following claims and their equivalents.

What is claimed is:

1. A valve system comprising:

a controller; and a valve including a valve element and a valve bore, the valve element selectively movable relative to the valve bore at least partially in response to a signal communicated from the controller, the communicated signal being at least partially based on a load on a hydraulic actuator and a determined pressure drop for the valve, the determined pressure drop being at least partially based on a hysteretic filter.

2. The valve of claim 1, wherein the valve is configured to selectively direct pressurized fluid from the hydraulic actuator toward a low pressure source.

3. The valve of claim 1, wherein the hysteretic filter includes minimum and maximum threshold values and the signal does not affect movement of the valve element when determined load pressure is greater than the minimum threshold value and less than the maximum threshold value.

4. The valve of claim 3, wherein:

the maximum threshold value is the algebraic inverse of a first functional relationship based on a previously determined pressure drop;

the minimum threshold value is the algebraic inverse of a second functional relationship based on the previously determined pressure drop.

5. The valve of claim 4, wherein:

the first functional relationship relates load pressures and pressure drops for decreasing load pressures; and the second functional relationship relates load pressures and pressure drops for increasing load pressures.

6. The valve of claim 4, wherein the determined pressure drop substantially equals the previously determined pressure drop when the determined load pressure is greater than the minimum threshold value and less than the maximum threshold value.

7. The valve of claim 1, wherein:

the valve element is movable between a flow blocking position in which pressurized fluid is not allowed to flow toward a low pressure source and a plurality of flow passing positions in which pressurized fluid is allowed to flow toward a low pressure source; and the signal affects movement of the valve element to one of the plurality of flow passing positions.

8. The valve of claim 1, wherein the valve element selectively moves in response to changing load on the hydraulic actuator.

9. The valve of claim 1, wherein the controller is configured to determine:

a flow of pressurized fluid desired to flow through the valve in response to the actuation of another valve configured to direct pressurized fluid to the hydraulic actuator;

the load on the hydraulic actuator based on a function of pressure signals indicative of pressures of pressurized fluid directed to and from the hydraulic actuator;

the determined pressure drop as a hysteretic function of the load pressure; and a flow area of the valve based on a function of the determined flow of pressurized fluid and the determined pressure drop.

10. A method of actuating a valve having a valve element movable relative to a valve bore, the method comprising:

determining a desired flow of pressurized fluid through the valve at least partially based on an operator input;

determining a load on an actuator fluidly connected upstream of the valve;

determining a desired pressure drop at least partially based on the determined load pressure and a hysteretic filter;

determining a desired flow area of the valve at least partially based on the determined flow of pressurized fluid and the determined pressure drop; and moving the valve element to establish the determined flow area.

11. The method of claim 10, wherein determining the load on the actuator includes:

sensing a first pressure of pressurized fluid directed to a first chamber of the hydraulic actuator;

sensing a second pressure of pressurized fluid directed from a second chamber of the hydraulic actuator; and establishing the load on the actuator as a function of the first and second sensed pressures.

12. The method of claim 10, wherein the pressure drop is determined as a function of:

a first functional relationship when the load pressure is increasing; and a second functional relationship when the load pressure is decreasing;

wherein the second functional relationship establishes a larger pressure drop than the first functional relationship for a given load pressure.

13. The method of claim 10, wherein the hysteretic filter includes:

inputting a first pressure drop indicative of a previously determined pressure drop;

determining maximum and minimum threshold values;

inputting the determined load on the actuator;

comparing the determined load on the actuator with the maximum and minimum threshold values; and determining a second pressure drop as being substantially equal to the first pressure drop when the determined load pressure is less than the maximum threshold value and greater than the minimum threshold value.

14. The method of claim 13, wherein the hysteretic filter further includes:

determining the maximum threshold value at least partially based on the algebraic inverse of a first functional relationship; and determining the minimum threshold value at least partially based on the algebraic inverse of a second functional relationship.

15. A hydraulic system comprising:

a controller configured to communicate a command signal;

a low pressure source;

a first actuator; and a first valve disposed between the low pressure source and the first actuator, the first valve being configured to selectively direct pressurized fluid from the first actuator to the low pressure source in response to the command signal, wherein the command signal is determined at least partially based on a load on the actuator and a hysteretic filtered pressure drop.

16. The hydraulic system of claim 15, further including:

a source of pressurized fluid; and a second valve disposed between the source and the first actuator, the second valve being configured to selectively direct pressurized fluid from the source to the first actuator;

wherein the controller is further configured to communicate the command signal when the second valve directs fluid to the first actuator.

17. The hydraulic system of claim 15, further including:

a first pressure sensor configured to communicate a signal to the controller indicative of the pressurized fluid directed to the first actuator; and a second pressure sensor configured to communicate a signal to the controller indicative of the pressurized fluid directed from the first actuator.

18. The hydraulic system of claim 15, wherein the controller is configured to determine the command signal by:

determining a desired flow of pressurized fluid through the first valve;

determining the load on the actuator;

determining a desired pressure drop based on the hysteretic filter;

determining a desired flow area of the first valve based on a function of the desired flow and the desired pressure drop.

19. The hydraulic system of claim 18, wherein the command signal affects movement of a valve element of the first valve relative to a valve bore to establish the desired flow area.

20. The hydraulic system of claim 15, wherein the hysteretic filter includes:

establishing minimum and maximum threshold values;

comparing a determined load on the actuator with the minimum and maximum threshold values; and determining the desired pressure drop as a function of the determined load on the actuator.

21. The hydraulic system of claim 20, wherein the minimum threshold value is different in magnitude than the maximum threshold value.

* * * * *